US008011858B2

(12) United States Patent
Pallini et al.

(10) Patent No.: US 8,011,858 B2
(45) **Date of Patent: *Sep. 6, 2011**

(54) RAM STYLE TENSIONER WITH FIXED CONDUCTOR AND FLOATING FRAME

(75) Inventors: Joseph W. Pallini, Tomball, TX (US); Edward A. Mendoza, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/629,704

(22) Filed: Dec. 2, 2009

(65) Prior Publication Data

US 2010/0143047 A1 Jun. 10, 2010

Related U.S. Application Data

(63) Continuation of application No. 11/970,974, filed on Jan. 8, 2008, now Pat. No. 7,632,044.

(60) Provisional application No. 60/879,275, filed on Jan. 8, 2007.

(51) Int. Cl.
*E21B 19/00* (2006.01)

(52) U.S. Cl. ..... 405/224.4

(58) Field of Classification Search ..... 405/224.4, 405/224.3, 224.2, 223.1, 224; 166/367
See application file for complete search history.

(56) References Cited

U.S. PATENT DOCUMENTS

| | | | | |
|---|---|---|---|---|
| 4,100,752 | A | 7/1978 | Tucker | |
| 4,787,778 | A * | 11/1988 | Myers et al. | 405/224.4 |
| 5,069,488 | A | 12/1991 | Freyer et al. | |
| 5,366,324 | A | 11/1994 | Arlt | |
| 5,551,803 | A | 9/1996 | Pallini, Jr. et al. | |
| 6,746,182 | B2 | 6/2004 | Munk et al. | |
| 7,112,011 | B2 | 9/2006 | McCarty et al. | |
| 7,217,067 | B2 | 5/2007 | Mao | |
| 7,329,070 | B1 | 2/2008 | Trent | |
| 7,334,967 | B2 | 2/2008 | Blakseth et al. | |
| 7,632,044 | B2 * | 12/2009 | Pallini et al. | 405/224.4 |
| 7,708,498 | B2 | 5/2010 | Ellis | |
| 2005/0074296 | A1 * | 4/2005 | McCarty et al. | 405/224.4 |
| 2005/0123359 | A1 * | 6/2005 | McCarty et al. | 405/224.4 |
| 2005/0129464 | A1 | 6/2005 | Moncus | |
| 2005/0147473 | A1 | 7/2005 | Pallini et al. | |
| 2007/0048094 | A1 * | 3/2007 | Mao et al. | 405/224.4 |
| 2008/0205992 | A1 * | 8/2008 | Ellis et al. | 405/224.4 |

FOREIGN PATENT DOCUMENTS

| | | |
|---|---|---|
| EP | 0088608 A2 | 9/1983 |
| EP | 0088608 A3 | 9/1983 |

* cited by examiner

*Primary Examiner* — Frederick L Lagman

(74) *Attorney, Agent, or Firm* — Bracewell & Giuliani LLP

(57) ABSTRACT

A riser tensioner for an offshore floating platform has a frame stationarily mounted to the upper portion of the riser. Pistons and cylinders are spaced circumferentially around the riser and connected between the frame and the floating platform. A tubular guide member is mounted to the floating platform for movement in unison in response to waves and currents. The riser extends through the guide member. A guide roller support is mounted to and extends downward from the frame around the guide member. At least one set of guide rollers is mounted to the guide roller support in rolling engagement with the guide member as the guide member moves in unison with the platform.

15 Claims, 3 Drawing Sheets

RAM STYLE TENSIONER WITH FIXED CONDUCTOR AND FLOATING FRAME

This application is a continuation of Ser. No. 11/970,974, filed Jan. 8, 2008 now U.S. Pat. No. 7,632,044, which claims priority to provisional application Ser. No. 60/879,275, filed Jan. 8, 2007.

CROSS-REFERENCE TO RELATED APPLICATION

This application claims priority to provisional patent application 60/879,275, filed Jan. 8, 2007.

FIELD OF THE INVENTION

This invention relates generally to tensioner assemblies and in particular to a riser tensioner assembly associated with a riser extending from subsea well equipment to a floating platform.

BACKGROUND OF THE INVENTION

A floating production platform is often used for deep water offshore oil and gas production. One or more risers extend from subsea equipment on the sea floor, such as a manifold or subsea production tree. The riser extends through an opening in the platform. A riser tensioner is mounted on the platform to apply and maintain tension in the riser.

The tensioner typically comprises a plurality of pistons and cylinders mounted between the platform and a frame secured to the riser. Fluid pressure is applied to the cylinders to apply tension to the riser. The platform moves toward and away from the subsea equipment in response to waves and currents. The riser, of course, is relatively stationary at the surface, so the movement of the platform causes the pistons and cylinders to stroke inward and outward.

To avoid damage to the riser due to platform movement, guide rollers may be employed to engage the riser or a conductor pipe surrounding an upper portion of the riser. The guide rollers are typically mounted to the platform for movement in unison with the platform.

SUMMARY

The riser tensioner has a frame stationarily mounted to the upper portion of the riser. A plurality of pistons and cylinders are mounted between the frame and the floating platform. The cylinders are supplied with a pressurized fluid to apply tension to the riser. A guide member is mounted to the floating platform for movement in unison in response to waves and currents. A bearing support is stationarily mounted to and extending from the frame. A bearing is mounted to the bearing support in movable engagement with the guide member as the guide member moves in unison with the platform. In the preferred embodiment, the bearing comprises a set of rollers. The guide member and the guide roller or bearing support are in telescoping relation ship with one another.

In the embodiment shown, the guide member is tubular, and the riser extends through the guide member. In this embodiment, the platform has an upper deck and a lower deck. The piston and cylinders are mounted to the upper deck. The guide member is mounted to the lower deck and extends upward through an opening in the upper deck.

DETAILED DESCRIPTION OF THE INVENTION

Figure 1:
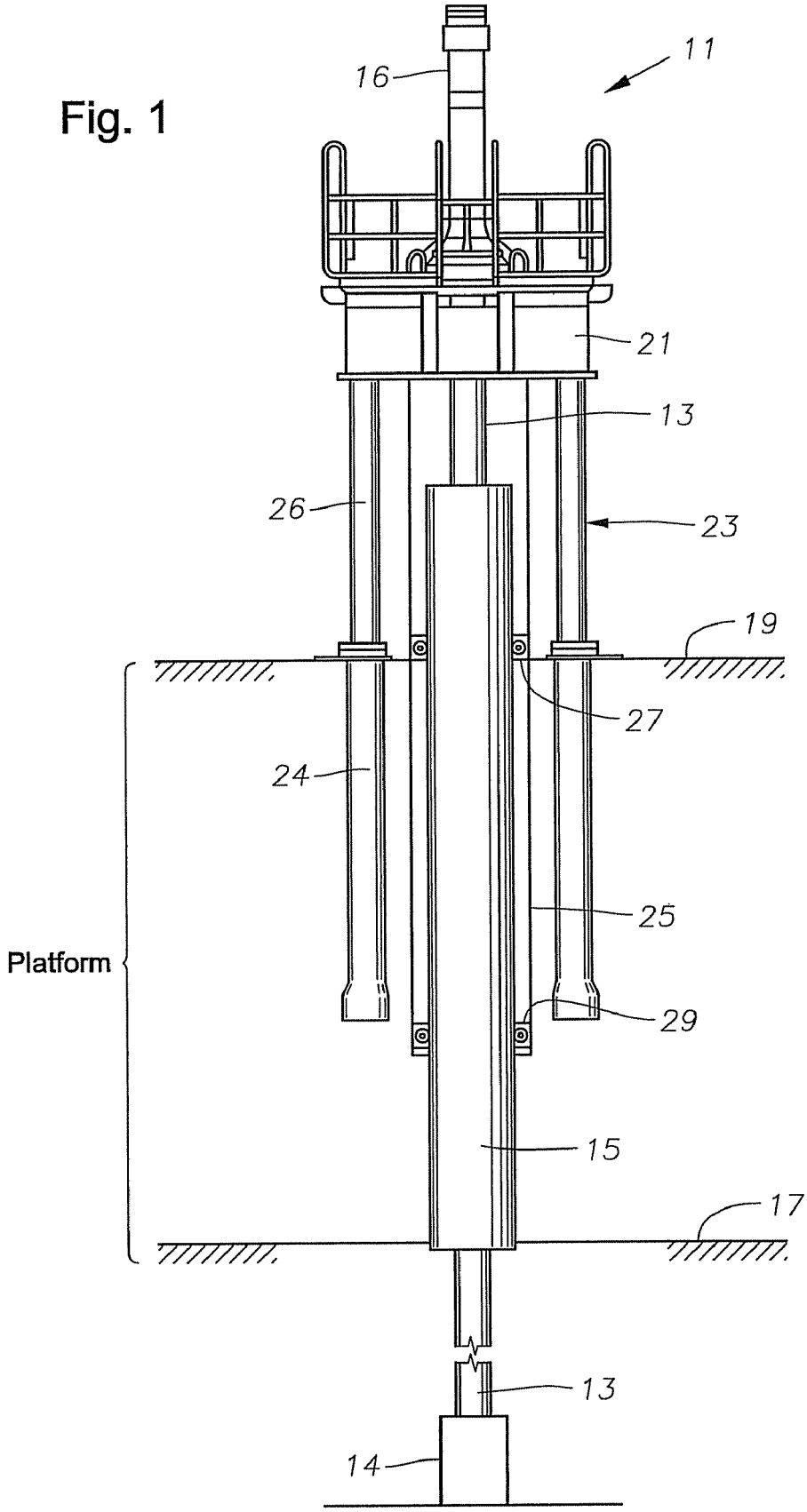
FIG. 1 is a schematic view of a riser tensioner assembly, built in accordance with the present invention, and in an intermediate position.

Referring to FIG. 1, a riser tensioner assembly 11 is associated with a riser 13 extending between subsea well equipment 14 on the sea floor and a floating production facility or platform at the surface. The subsea well equipment 14 may be a subsea wellhead, production tree, manifold or other facilities for conveying well fluids to the floating production facility. The lower end of riser 13 is stationarily mounted to subsea well equipment 14. Riser 13 is fixed in length and extends upward from subsea well equipment 14 through an opening in the floating platform.

In this embodiment, riser 13 extends through a conductor or guide member 15 mounted stationarily on the production facility. Guide member 15 is preferably tubular and has an inner diameter larger than an outer diameter of riser 13. Riser 13 extends above guide member 15 to a riser mandrel 16 for interfacing with equipment on the production facility. The lower end of guide member 15 may be located at the bottom of the floating production facility.

The platform preferably includes a lower deck 17 that is rigidly connected to guide member 15 such that guide member 15 is stationary relative to lower deck 17 and the rest of the platform. The platform also has an upper deck 19 that is a fixed distance from lower deck 17. In this example, upper deck 19 serves as a base for riser tensioner assembly 11 to actuate from.

Figure 2:
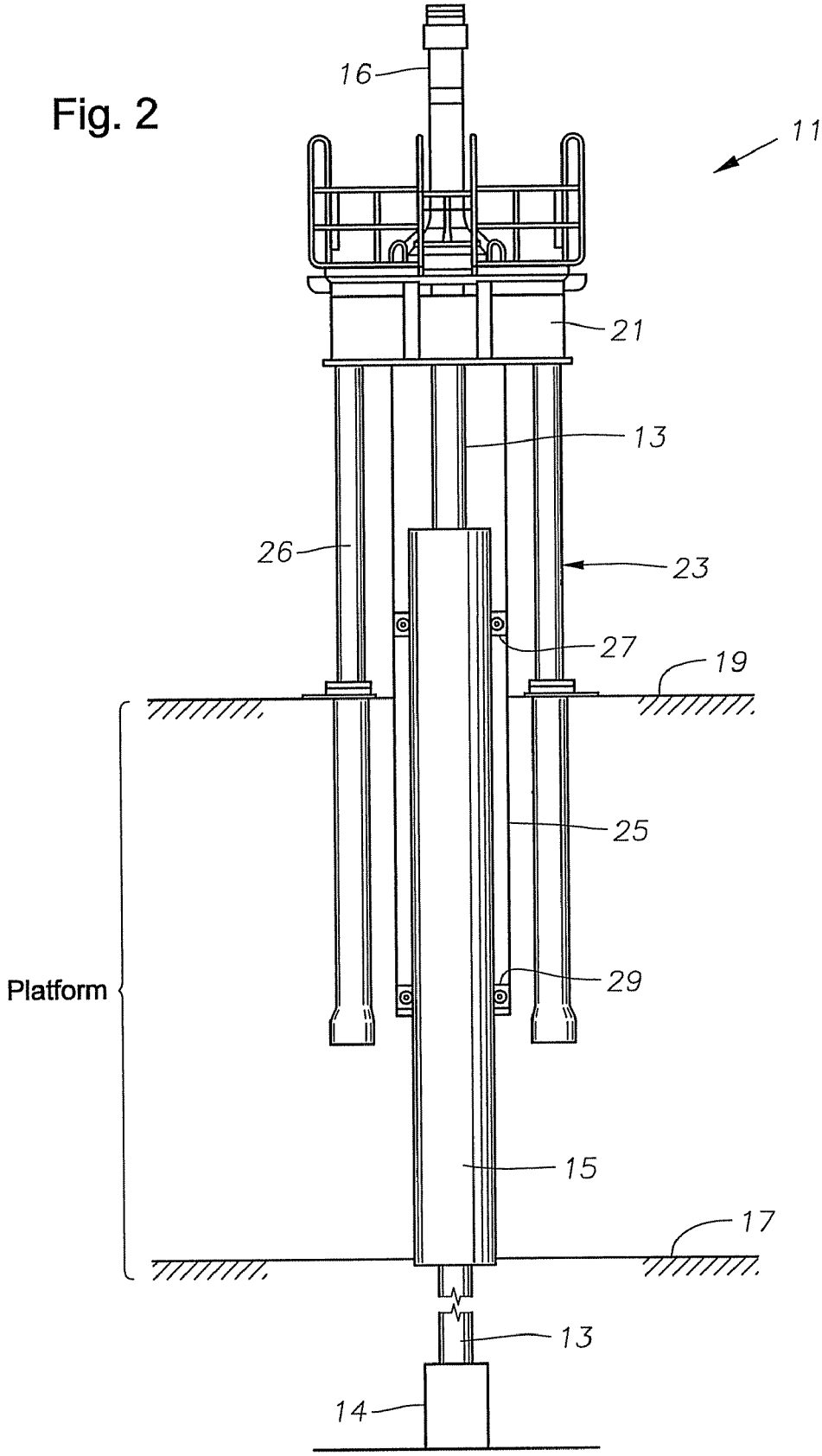
FIG. 2 is a schematic view of the riser tensioner assembly of FIG. 1, in an extended position.
Figure 3:
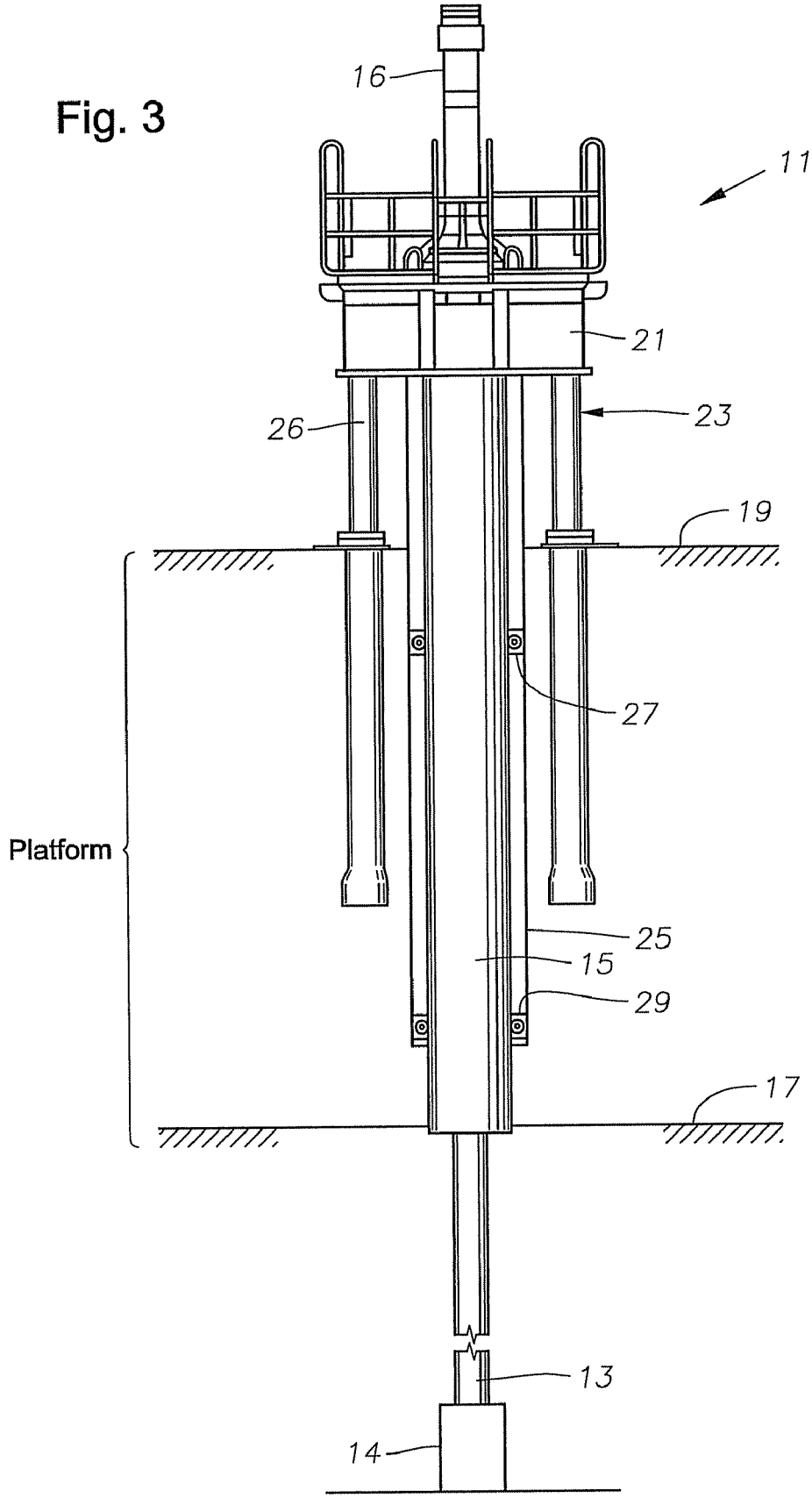
FIG. 3 is a schematic view of the riser tensioner assembly of FIG. 1, in a retracted position.

Riser tensioner assembly 11 preferably includes a top frame 21 positioned above upper deck 19 and stationarily mounted to riser mandrel 16. A plurality of hydro-pneumatic cylinder assemblies 23 extend axially downward from frame 21 and connect to upper deck 19. In the preferred embodiment, cylinder assemblies 23 are circumferentially spaced around riser 13. Each cylinder assembly 23 comprises a cylinder or cylinder 24 and a piston 26 such that cylinder assemblies 23 actuate between an extended position as shown in FIG. 2 and a retracted position as shown in FIG. 3. Preferably each cylinder 24 is mounted stationarily to upper deck 19 and the upper end of each piston 26 is mounted to frame 21. However, that arrangement could be reversed. Cylinder assemblies 23 exert an upward tensile force on riser 13 and help to alleviate changes in axial loads on riser 13 due to movement of the production facility toward and away from subsea equipment 14 in response to waves and currents.

A guide roller or bearing support 25 extends downward from frame 21 around an upper portion of guide member 15. In the example shown, guide roller support 25 comprises frame members or braces spaced circumferentially apart from each other. Each brace extends parallel with an axis of guide member 15. Alternately, guide roller support could be tubular in order to receive and surround a portion of guide member 15. Guide roller support 25 has a lower end that is spaced above the lower end of guide member 15, even during a minimum stroke position, as shown in FIG. 3. Guide roller support 25 is rigidly connected to frame 21 such that guide roller support 25 is stationary with frame 21 and riser 13. Decks 17, 19 and guide member 15 move axially upward and downward relative to guide roller support 25.

Upper and lower bearings 27, 29 are mounted to guide roller support 25 for rolling engagement with the exterior of guide member 15. Each bearing, is preferably a set of rollers 27, 29, which comprises a plurality of rollers spaced circumferentially around guide member 15. Upper and lower rollers 27, 29 aid in the movement, of guide member 15 relative to guide roller support 25 as guide member 15 moves axially upward and downward relative to guide roller support 25. In the preferred embodiment, rollers 27, 29 are axially spaced apart and mounted on the inner side of guide member 15. Axially spacing apart rollers 27, 29 helps to distribute forces from guide member 15 to guide roller support 25 so that riser tensioner assembly 11 transfers moment forces associated with movements of the production facility through guide member 15 and guide roller support 25 rather than directly to riser 13.

FIG. 1 shows tension assembly 11 in an intermediate position, with pistons 26 partly extended and frame 21 spaced above the upper end of guide member 15. In FIG. 2, the production vessel has moved downward or closer to the subsea well equipment 14 from the position in FIG. 1. Because riser mandrel 16 is stationary, pistons 26 have extended from the position in FIG. 1. The upper end of guide member 15 is farther from frame 21 than in FIG. 1. The upper end of guide member 15 is closer to the upper set of rollers 27 than in FIG. 1.

In FIG. 3, the production vessel has moved farther from the subsea well equipment 14 due to waves or current. Pistons 26 have contracted and the upper end of guide member 15 is substantially in contact with frame 21. Guide member 15 has moved upward such that the lower set of rollers 29 is now engaging guide member 15 near its lower end.

Although some embodiments of the present invention have been described in detail, it should be understood that various changes, substitutions, and alterations can be made hereupon without departing from the principle and scope of the invention. For example, rather than guide rollers to serve as the bearings, bushings could be used. Also, rather than a single, central guide member that receives the riser, a plurality of offset guide members could be employed. These offset guide members would not receive a riser, rather they would be mounted circumferentially around the riser, such as between some of the cylinder assemblies. A mating upper guide roller set would be mounted to the top frame for each offset guide member. In that instance the offset guide members would extend through the upper end of the top frame.

The invention claimed is:

1. An offshore facility having a floating platform, a riser having a lower end adapted to be secured to subsea equipment and an upper portion at the platform, an improved riser tensioner, comprising:

a frame stationarily mounted to the upper portion of the riser;

a plurality of pistons and cylinders, each piston and cylinder being mounted between the frame and the floating platform, the cylinders being supplied with a pressurized fluid to apply tension to the riser;

a guide member mounted to the floating platform for movement in unison in response to waves and currents; and at least one bearing carried stationarily by the frame and in movable engagement with the guide member as the guide member moves in unison with the platform.

2. The facility according to claim 1, wherein:

the guide member is an elongated tubular member.

3. The facility according to claim 1, wherein:

the platform has first and second decks, one spaced above the other;

the piston and cylinders comprise hydro-pneumatic cylinder assemblies and are mounted to the first deck; and the guide member is mounted to the second deck.

4. The facility according to claim 1, wherein the bearing comprises a set of guide rollers extending at least partially circumferentially around the guide member and in rolling engagement with the guide member.

5. The facility according to claim 1, wherein the guide member has an end that is below the frame.

6. The facility according to claim 1, further comprising:

a bearing support mounted to and extending from the frame; and wherein the bearing is mounted to the bearing support.

7. The facility according to claim 1, wherein the guide member has one end secured to the platform.

8. The facility according to claim 1, further comprising:

a plurality of elongated braces spaced circumferentially around the guide member and mounted stationarily to the frame; and wherein the bearing is mounted to the elongated braces a fixed distance from the frame.

9. A riser tensioner system for applying tension to a riser extending from a subsea location to a floating surface platform, comprising:

a first member adapted to be coupled to the riser to enable a force applied to the first member to be transferred to the riser;

a plurality of piston and cylinder assemblies adapted to be secured to the surface platform, wherein each piston and cylinder assembly is coupled to the first member to enable the plurality of piston and cylinder assemblies to provide a force to the first member to maintain the riser in tension;

a guide member adapted to be secured to the surface platform for movement therewith and adapted to guide relative movement the first member and the surface platform; and at least one roller assembly carried by the first member and in rolling engagement with the guide member to enable the first member to roll along a length of the guide member as the guide member moves with the surface platform.

10. The riser tensioner system as recited in claim 9, wherein each of the plurality of piston and cylinder assemblies is a hydro-pneumatic cylinder assembly.

11. A method for applying tension to a riser extending from a subsea location to a floating surface platform, comprising:

coupling a first member to the riser to enable a force applied to the first member to be transferred to the riser;

securing a plurality of piston and cylinder assemblies to the surface platform and the first member to enable the plurality of piston and cylinder assemblies to provide a force to the first member to maintain the riser in tension;

securing a guide member to the surface platform, and with the guide member, guiding relative movement between the first member and the surface platform; and coupling at least one roller assembly to the first member and rolling the roller assembly along a length of the guide member as the surface platform and the guide member move in unison relative to the first member.

12. An offshore facility, comprising:

a floating platform;

a riser having a lower end adapted to be secured to subsea equipment and an upper portion at the platform;

a frame stationarily mounted to the upper portion of the riser;

a plurality of hydro-pneumatic cylinder assemblies, each cylinder assembly mounted between the frame and the floating platform, the cylinder assemblies being supplied with a pressurized fluid to apply tension to the riser;

a guide member mounted to the floating platform for movement in unison with the platform in response to waves and currents; and at least one set of rollers mounted to the frame and in rolling engagement with the guide member as the guide member and frame move relative to each other.

13. The facility according to claim 12, wherein:

the guide member is an elongated tubular member.

14. The facility according to claim 12, wherein:

the platform has first and second decks, one spaced above the other;

the cylinder assemblies have pistons with upper ends mounted to the frame;

the cylinder assemblies have cylinders with upper ends mounted to the first deck; and the guide member has one end mounted to the second deck.

15. An offshore facility, comprising:

a floating platform;

a riser having a lower end adapted to be secured to subsea equipment and an upper portion at the platform;

a frame fixed to the upper portion of the riser;

a plurality of pistons and cylinders, each piston having an upper end mounted to the frame, each cylinder having an upper end mounted to a deck of the floating platform for movement with the platform, the cylinders being supplied with a pressurized fluid to apply tension to the riser;

an elongated, vertically extending tubular guide member having an end mounted to the floating platform for movement therewith; and at least two rollers mounted to the frame and in rolling engagement with opposite sides of the guide member as the guide member moves in unison with the platform.

* * * * *